US011805924B2

(12) United States Patent
Abdelmesih et al.

(10) Patent No.: US 11,805,924 B2
(45) **Date of Patent: *Nov. 7, 2023**

(54) SECURE DISPLAY FOR EASY LOADING OF SMALL FORMAT BEVERAGE CONTAINERS

(71) Applicant: E. & J. Gallo Winery, Modesto, CA (US)

(72) Inventors: Peter Abdelmesih, Alameda, CA (US); Philip West, Pleasanton, CA (US)

(73) Assignee: E. & J. Gallo Winery, Modesto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/683,117

(22) Filed: Feb. 28, 2022

(65) Prior Publication Data

US 2022/0232998 A1 Jul. 28, 2022

Related U.S. Application Data

(63) Continuation of application No. 16/674,818, filed on Nov. 5, 2019, now Pat. No. 11,278,130.

(60) Provisional application No. 62/758,135, filed on Nov. 9, 2018, provisional application No. 62/818,516, filed on Mar. 14, 2019, provisional application No. 62/908,975, filed on Oct. 1, 2019.

(51) Int. Cl.

| | |
|---|---|
| ***A47F 1/10*** | (2006.01) |
| ***A47F 1/08*** | (2006.01) |
| ***A47B 73/00*** | (2006.01) |

(52) U.S. Cl.

CPC ..... *A47F 1/087* (2013.01); *A47B 73/00* (2013.01); *A47F 1/08* (2013.01); *A47F 1/10* (2013.01)

(58) Field of Classification Search

CPC ..... A47F 1/087

See application file for complete search history.

(56) References Cited

U.S. PATENT DOCUMENTS

| | | | | |
|---|---|---|---|---|
| 777,043 | A | 12/1904 | McClean | |
| 1,023,116 | A | 4/1912 | Bailey | |
| 3,010,556 | A | 11/1961 | Wawrozonek | |
| 3,055,293 | A * | 9/1962 | Lariccia | A47F 1/087 193/27 |
| 5,234,107 | A * | 8/1993 | Morel | B65D 73/0042 206/467 |
| 6,206,237 | B1 | 3/2001 | Dillon et al. | |
| 7,674,153 | B2 | 3/2010 | King | |
| 7,843,295 | B2 | 11/2010 | Fullerton et al. | |
| 8,485,391 | B2 | 7/2013 | Vlastakis et al. | |
| 10,058,195 | B2 | 8/2018 | Bernard et al. | |
| 11,278,130 | B2 * | 3/2022 | Abdelmesih | A47F 1/08 |
| 2004/0007546 | A1 | 1/2004 | Stinnett et al. | |

(Continued)

OTHER PUBLICATIONS

Int'l Search Report and Written Opinion of the ISA/US in PCT/US2019/059875; dated Jan. 27, 2020; 16 pages.

*Primary Examiner* — Gene O Crawford
*Assistant Examiner* — Ayodeji T Ojofeitimi
(74) *Attorney, Agent, or Firm* — Goodwin Procter LLP

(57) ABSTRACT

An apparatus for the display of small format beverage containers is disclosed. According to one embodiment, an apparatus comprises a front door that allows access to beverage containers; front panels; a left panel and a right panel; a loading opening; back panels; bottom panels; and an internal channel having a curved ramp that stores beverage containers.

18 Claims, 8 Drawing Sheets

(56) References Cited

U.S. PATENT DOCUMENTS

| | | | | |
|---|---|---|---|---|
| 2006/0027639 | A1 | 2/2006 | Rasmussen | |
| 2007/0007221 | A1 | 1/2007 | Mann | |
| 2013/0105506 | A1 | 5/2013 | Frias et al. | |
| 2013/0213992 | A1* | 8/2013 | Wichmann | A47K 10/425 221/56 |
| 2013/0248555 | A1 | 9/2013 | Klier et al. | |
| 2014/0312051 | A1* | 10/2014 | Rose, Jr. | G07F 7/0609 221/124 |

* cited by examiner

600

700

800

SECURE DISPLAY FOR EASY LOADING OF SMALL FORMAT BEVERAGE CONTAINERS

CROSS-REFERENCE TO RELATED APPLICATIONS

The present application is a continuation of U.S. patent application Ser. No. 16/674,818, entitled "Secure Display for Easy Loading of Small Format Beverage Containers," filed on Nov. 5, 2019, which claims the benefit of and priority to U.S. Provisional Application Ser. No. 62/758,135, entitled "Apparatus for the Display of Small Format Beverage Containers," filed on Nov. 9, 2018, U.S. Provisional Application Ser. No. 62/818,516, entitled "Apparatus for the Display and Theft Deterrence of Small Format Beverage Containers," filed on Mar. 14, 2019, and U.S. Provisional Application Ser. No. 62/908,975, entitled "Secure Display for Easy Loading of Small Format Beverage Containers," filed on Oct. 1, 2019, each of which is hereby incorporated by reference in its entirety.

FIELD

The present application relates in general to the field of beverage displays. In particular, the present disclosure is directed to an apparatus for the display of small format beverage containers.

BACKGROUND

Merchandising display racks are not only used to shelve items awaiting purchase by a consumer so that the items are available, but are also used to arrange available items attractively and make them easy to recognize. In the beverage industry there is fierce competition for shelf space so that making available items attractive and easy to recognize is crucial. Further, taking advantage of the provided space in a display rack would allow more flow-through of products per loading cycle.

With any self-service shelving system a very important consideration, if not the most important, is the ease with which the consumer can retrieve the desired product from the display case. It would also be beneficial to provide a quick and easy method to load the system with products for sale and, in an effort to promote sales, prominently display the product or an ad related thereto.

SUMMARY

An apparatus for the display of small format beverage containers is disclosed. According to one embodiment, an apparatus comprises a front door that allows access to beverage containers; front panels; a left panel and a right panel; a loading opening; back panels; bottom panels; and an internal channel having a curved ramp that stores beverage containers.

Each of the features and teachings disclosed herein can be utilized separately or in conjunction with each other. Representative examples utilizing many of these additional features and teaching, both separately and in combination, are described in further detail with reference to the attached figures. This detailed description is merely intended to teach a person of skill in the art further details for practicing aspects of the present teachings and is not intended to limit the scope of the claims. Therefore, combinations of features disclosed above in the detailed description may not be necessary to practice the teachings in the broadest sense, and are instead taught merely to describe particularly representative examples of the present teachings.

BRIEF DESCRIPTION OF THE DRAWINGS

The foregoing will be apparent from the following more particular description of example embodiments of the invention, as illustrated in the accompanying drawings in which like reference characters refer to the same parts throughout the different views.

Figure 1:
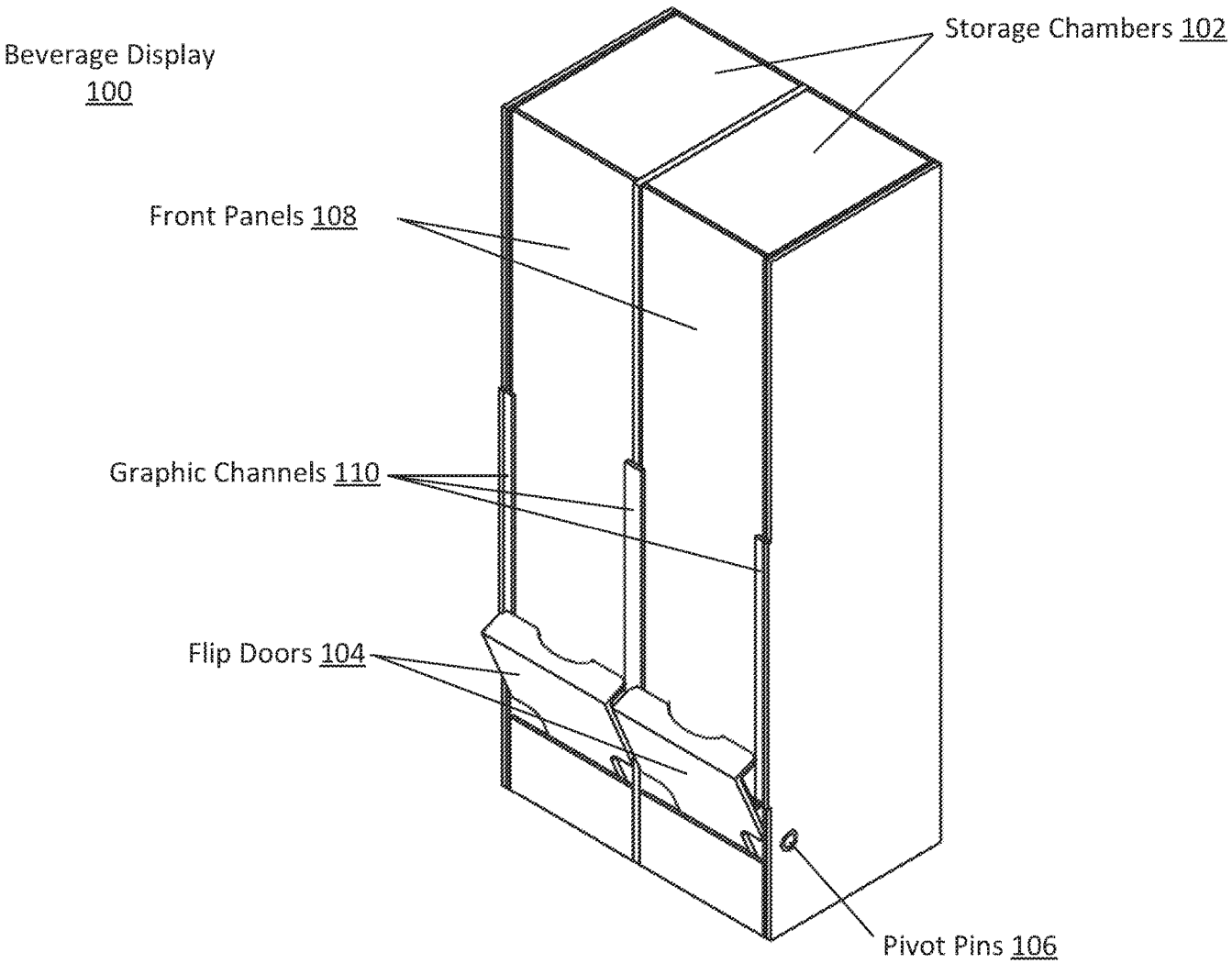
FIG. 1 illustrates a front perspective view of a container display, according to one embodiment.

The above and other preferred features, including various novel details of implementation and combination of elements, will now be more particularly described with reference to the accompanying drawings and pointed out in the claims. It will be understood that the particular methods and apparatuses are shown by way of illustration only and not as limitations. As will be understood by those skilled in the art, the principles and features explained herein may be employed in various and numerous embodiments.

DETAILED DESCRIPTION

An apparatus for the display of small format beverage containers is disclosed. According to one embodiment, an apparatus comprises a front door that allows access to beverage containers; front panels; a left panel and a right panel; a loading opening; back panels; bottom panels; and an internal channel having a curved ramp that stores beverage containers.

Briefly, and in general terms, various embodiments are directed to a beverage container display that provides secure storage and easy loading of small format beverage containers.

According to one embodiment, a beverage container display includes an inside channel to store beverage containers, openings to facilitate distribution of beverage containers, and an easy dispensing mechanism for each opening to activate the dispensing for a user, such as a door, sliding cover, or other dispensing mechanism. The beverage container display may be configured to receive beverage containers through various loading openings placed around the beverage container display.

The beverage container display further includes security mechanisms for providing accessibility to beverage containers within the beverage container display in a protected fashion. In addition to the dispensing mechanisms explained above, keyholes may be provided to attach the beverage container display to a base, counter, floor, wall or other structure to securely display the beverage containers while deterring theft of the beverage container display and the containers therein.

The following disclosure provides many different embodiments, or examples, for implementing different features of the subject matter. Specific examples of components and arrangements are described below to simplify the present disclosure. These are merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Any dimensions provided in the detailed description or Figures are provided for illustrative purposes only and do not limit the scope of the claims.

In the description below, for purposes of explanation only, specific nomenclature is set forth to provide a thorough understanding of the present disclosure. However, it will be apparent to one skilled in the art that these specific details are not required to practice the teachings of the present disclosure.

Merchandising display racks are not only used to shelve items awaiting purchase by a consumer so that the items are available, but are also used to arrange available items attractively and make them easy to recognize. There is intense competition for shelf space. In the beverage industry there is fierce competition so that making available items attractive and easy to recognize is crucial. The ease with which the consumer can securely retrieve the desired product from the display case remains one of the most important priorities of such a self-service shelving mechanism.

FIG. 1 illustrates a front perspective view of a container display 100 having dual storage chambers 102, according to one embodiment. Container display 100 includes two front openings covered by independent flip doors 104 through which a consumer may access a small format beverage container. According to various embodiments, the small format beverage container may be in the form of a bottle, can, carton, jar, capsule, bag, box, vial, or other liquid vessel. The small format beverage container may have a capacity of 50 mL and have a cylindrical shape. Container display 100 may store 48 small format beverage containers (24 on each side), according to one embodiment. According to some embodiments, container display 100 may store more or less than 48 small format beverage containers. The access to small format beverage containers is limited by the flip doors 104 that remain closed, unless opened when a user lowers the door by pulling downward on the door. Front openings allow consumer access to a single beverage container per opening, according to one embodiment. Such a configuration minimizes the risk of theft of the small format beverage containers.

According to another embodiment, multiple beverage containers can be displayed and removed from each opening by way of the flip doors 104. Container display 100 shows two flip doors 104 in an upward position and their respective pivot pins 106 to hold the doors in place. Flip doors 104 swivel on pivot pins 106, which facilitate attaching the flip doors to the sides of container display 100, according to one embodiment. The flip doors 104 may use a spring-action mechanism to close the doors automatically after a user releases the doors, according to one embodiment. According to another embodiment, container display 100 also includes a stand that raises the display to the height of the stand, providing easy access for the user.

Container display 100 further includes front panels 108 which may provide support for displaying graphics or advertisements, according to some embodiments. Front panels 108 includes graphic channels 110. Graphic channels 110 may be located in between the two storage chambers 102 and the side edges of front panels 108 in which advertising sheets may be inserted.

Figure 2:
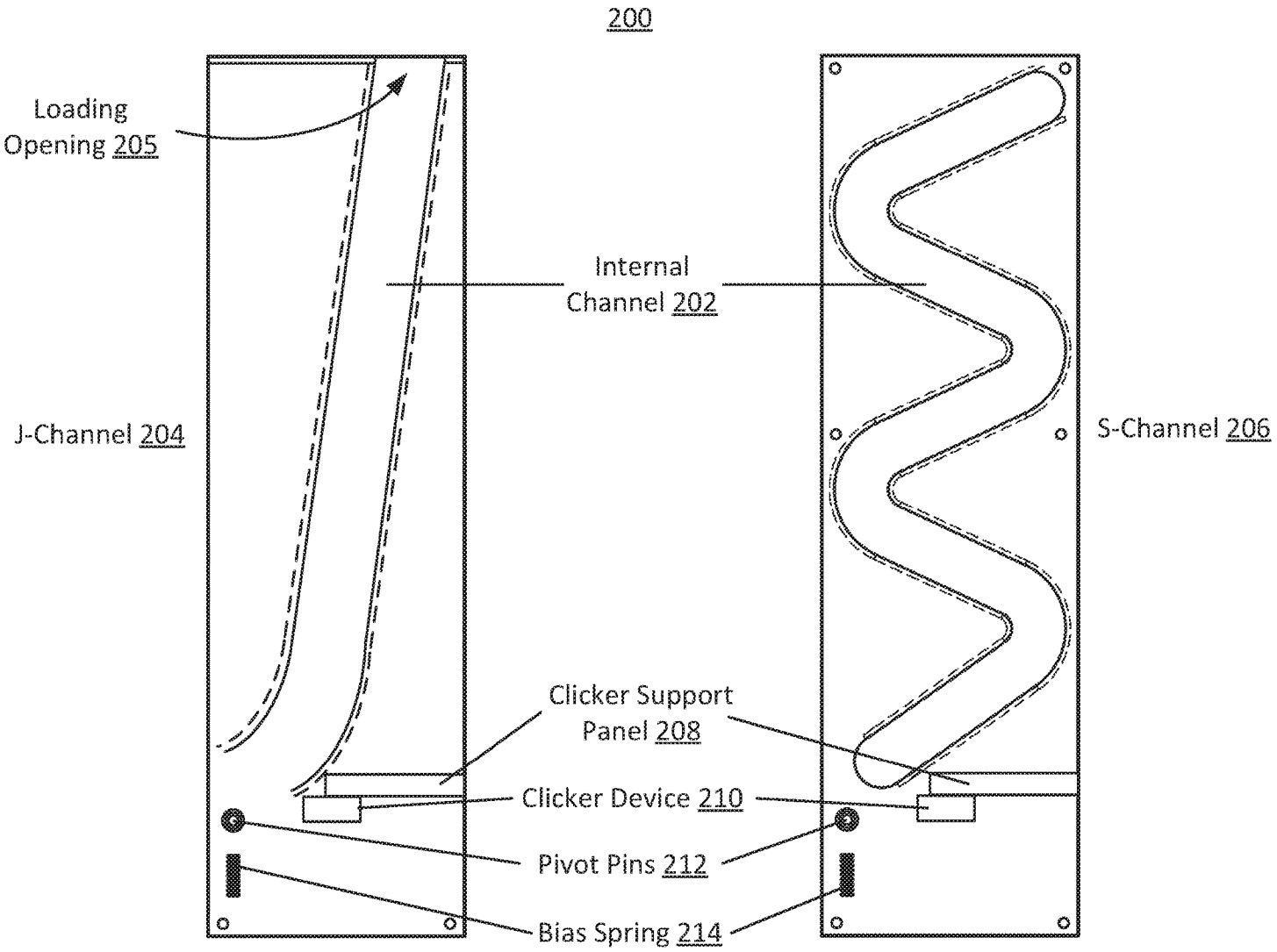
FIG. 2 illustrates section views of a container display, according to some embodiments.

FIG. 2 illustrates a side view of container display 200, according to some embodiments. Container display 200 includes a rectangular body and an internal channel 202 that extends from the top of container display 200 to the associated flip door. According to some embodiments, internal channel 202 may be provided by various formations or shapes. For example, FIG. 2 illustrates two exemplary embodiments of internal channel 202: J-channel 204 and S-channel 206. According to some embodiments, J-channel 204 may be provided as a ramp with an angled drop to prevent damage to the bottles during the loading and dispensing processes. J-channel 204 has a curved end to facilitate loading a bottle into the flip door when a user opens the flip door. According to some embodiments, J-channel 204 may be loaded from the back of container display 200 through loading opening 205. According to other embodiments, J-channel may not have a loading opening 205 and, instead, is loaded from the side as demonstrated by S-channel 206.

Container display 200 further illustrates another embodiment of internal channel 202 as S-channel 206. S-channel 206 provides for a ramp that winds back and forth within the storage chamber in an S-like formation. The S-like shape of the channel may prevent damage to the small format beverage containers during the serving process and reduce downward pressure for the small format beverage container to gently land in the flip door when the consumer opens it.

According to some embodiments, S-channel 206 may allow for easy loading of small format beverage containers without a loading opening, such as loading opening 205 as provided by J-channel 204. For example, S-channel 206 may be loaded from either side by removing magnetic side panels of container display 200. Magnetic side panels and their functionality will be explained in further detail below. According to other embodiments, S-channel 206 may also provide for a loading opening similar to loading opening 205 of J-channel 204, eliminating the need for the removal of magnetic side panels.

Container display 200 further shows clicker device 210, pivot pins 212, and bias spring attachments 214 to facilitate the opening of a flip door. Clicker device 210 may be actuated by a clicker actuating member of a flip door when it is opened. A clicker actuating member of a flip door inside container display 200 may be a protrusion that interfaces with clicker device 210. According to some embodiments, clicker device 210 is attached horizontally to a clicker support panel 208 inside container display 200. Clicker support panel 210 attaches to the inner rear and inner side walls of container display 200, according to some embodiments. Container display 200 shows pivot pins and bias spring attachments 214 to attach a flip door and facilitate the opening thereof. Further details regarding the attachment and functionality of a flip door is explained below.

Figure 3:
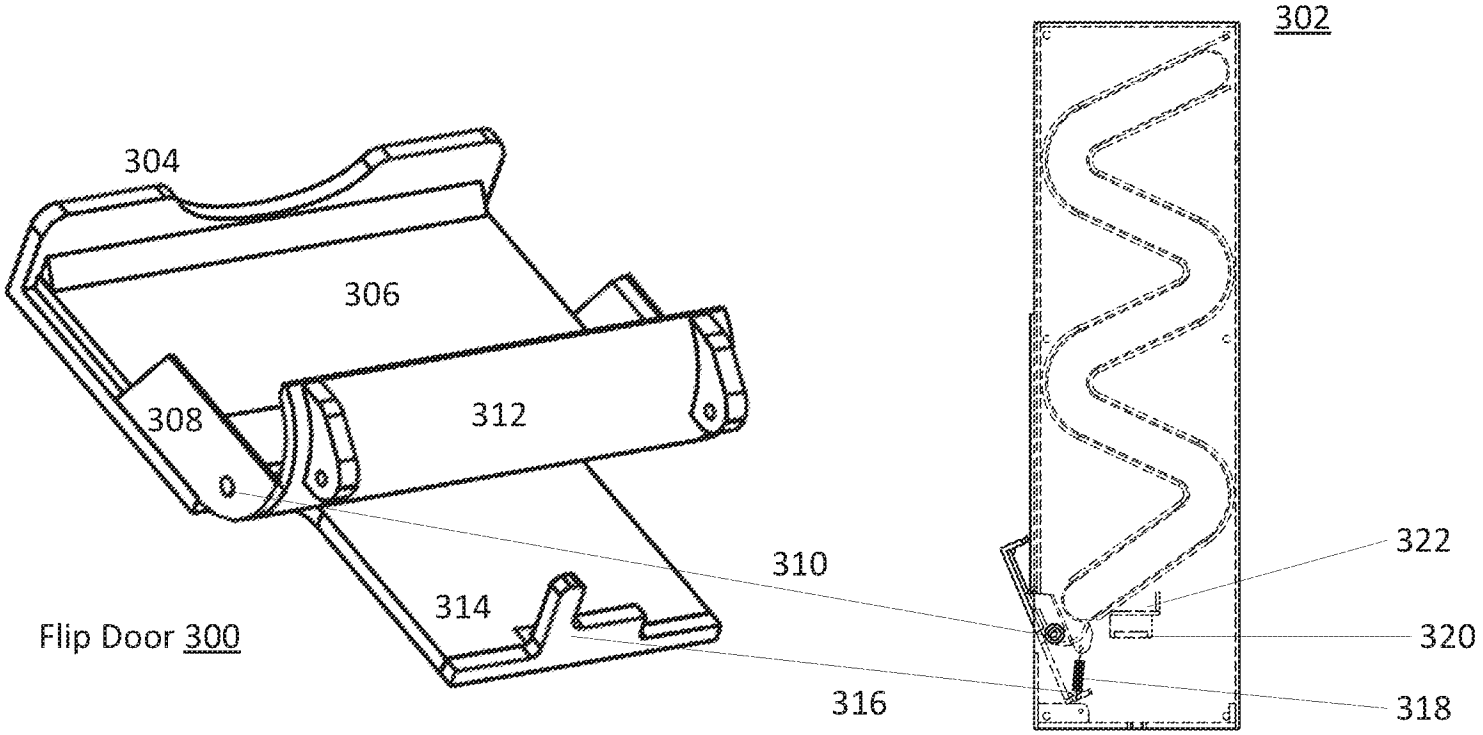
FIG. 3 illustrates a flip door, according to one embodiment.

FIG. 3 illustrates a flip door 300 for container display 302, according to one embodiment. Flip door 300 includes a front notched member 304 connected to a front bottom member 306. Flip door 300 also includes two side members 308, each having a pivot point 310, which may be a hole to accept a pivot pin or pivot screw that attaches to container display 302. According to some embodiments, flip door 300 has a curved member 312 that holds a single small format beverage container from the internal channel for dispensing to a user when the flip door 300 is opened. The curve of curved member 312 matches the curve of the small format beverage container, according to one embodiment. Flip door 300 includes a rear bottom member 314 that includes a clicker actuating member 316, mounted perpendicularly to the rear bottom member 314.

According to some embodiments, flip door 300 attaches to springs 318 to keep flip door 300 in an upward position, unless lowered by a user. When lowered, flip door 300 actuates a corresponding clicker device 320 when opened. Each flip door inside the container display, such as flip door 300, includes a clicker actuating member 316 that interfaces with corresponding clicker device 320 that is attached horizontally to a clicker support panel 322 inside container display 302.

According to some embodiments, clicker device 320 has a rectangular shape and contains a metal sheet that when in contact with clicker actuating member 316, makes a clicking noise. The clicking noise may be used to alert a store attendant that a small format beverage container has been removed from container display 302. The clicking noise also discourages theft by a consumer because the consumer's actions will not go undetected if an attendant can hear the clicking noise made when the small format beverage container is removed. Clicker device 320 may be attached to clicker support panel 322 using glue, screws or other appropriate fastening mechanisms, according to some embodiments.

Rear bottom member 314 is narrower than front bottom member 306 to avoid interference with springs 318 that attach flip door 300 to the inner sides of display container 302, according some embodiments. Springs 318 may cause flip door 300 to close once a user lets go of the flip door 300.

Figure 4:
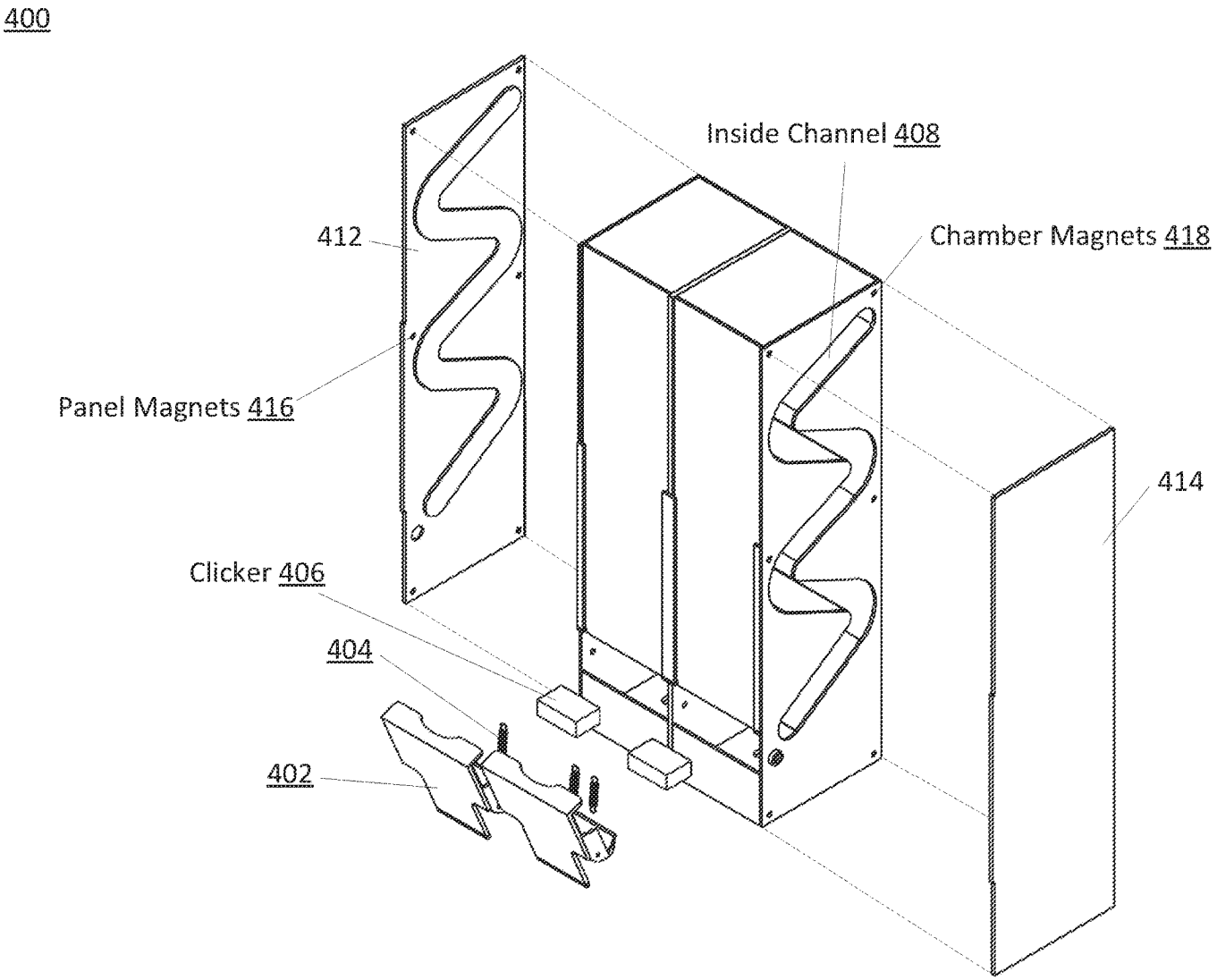
FIG. 4 illustrates an expanded view of a container display, according to one embodiment.

FIG. 4 illustrates an expanded view of a container display 400, according to some embodiments. The expanded view shows two flip doors 402 of container display 400 and corresponding springs 404 to facilitate the pivoting of flip doors 402. According to some embodiments, container display 400 also contains two clickers 406, one for each chamber. The chambers each include an inside channel. For demonstrative purposes only, container display 400 shows inside channel 408 as an S-channel with side-loading capabilities. However, container display 400 may display other channel formations (e.g., J-channel or another formation). Furthermore, container display 400 may further provide loading openings similar to loading opening 205 of FIG. 2 rather than the side-loading capabilities as demonstrated in FIG. 4.

FIG. 4 also demonstrates side-loading capabilities provided by two side panels, one for each side. Container display 400 includes an inside side panel 412, which illustrates the inside of an exemplary removable side panel, and an outside side panel 414, which illustrates the outside of an exemplary removable side panel. Inside side panel 412 shows panel magnets 416 on the inside to attach to container display 400. The chambers of container display 400 may include anchor magnets 418 embedded therein in order to magnetically receive and securely attach to panel magnets 416 of inside side panel 412. Outside side panel 414 may or may not display the location of panel magnets 416 of inside side panel 412. In fact, as demonstrated in FIG. 4, outside side panel 414 conceals the location of panel magnets 416. This concealment may provide the benefit of securely attaching a side panel to a container display without revealing the mechanisms of attachment, deterring thieves from taking advantage of such knowledge. Side panels 412 and 414 may be used to cover the inside channel and enclose the small format beverage containers.

Figure 5:
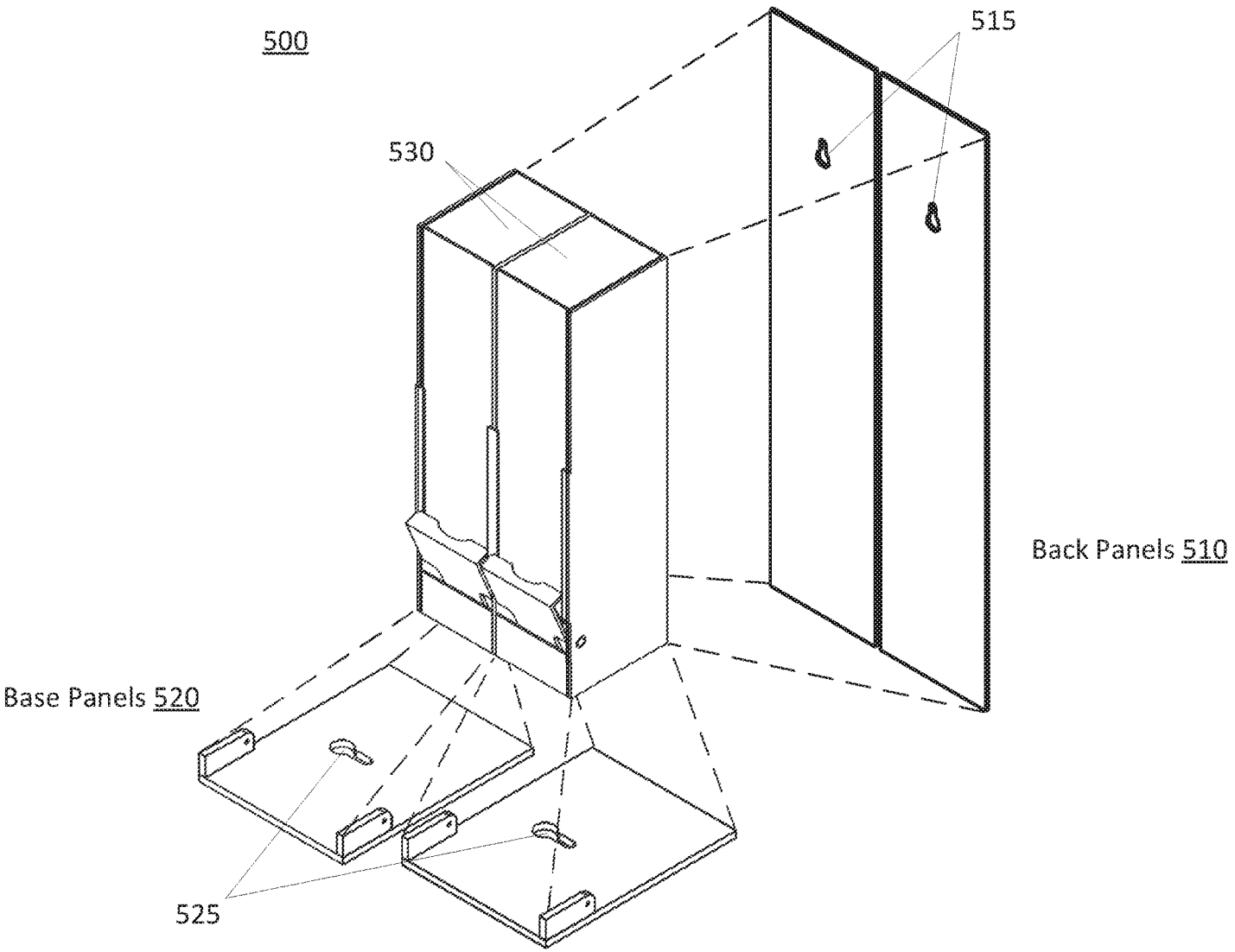
FIG. 5 illustrates an expanded view of a container display, according to one embodiment.

FIG. 5 illustrates container display 500 with keyhole panels. Container display 500 includes back panels 510 and base panels 520, wherein keyholes 515 and 525 may be provided respectively. Keyholes 515 found in back panels 510 may be used to facilitate attaching container display 500 to a wall or other secure structure. Keyholes 525 found in base panels 520 may be used to attach container display 500 to a display stand, counter, floor, or other secure structure. Keyholes 515 and 520 may be provided for the benefit of security, stability, and durability, among other benefits. According to some embodiments, more than one chamber of container display 500 may be mounted to a display stand, counter, floor, wall or other secure structure. For example, container display 500 demonstrates two mountable chambers 530, as shown in FIG. 5.

Figure 6:
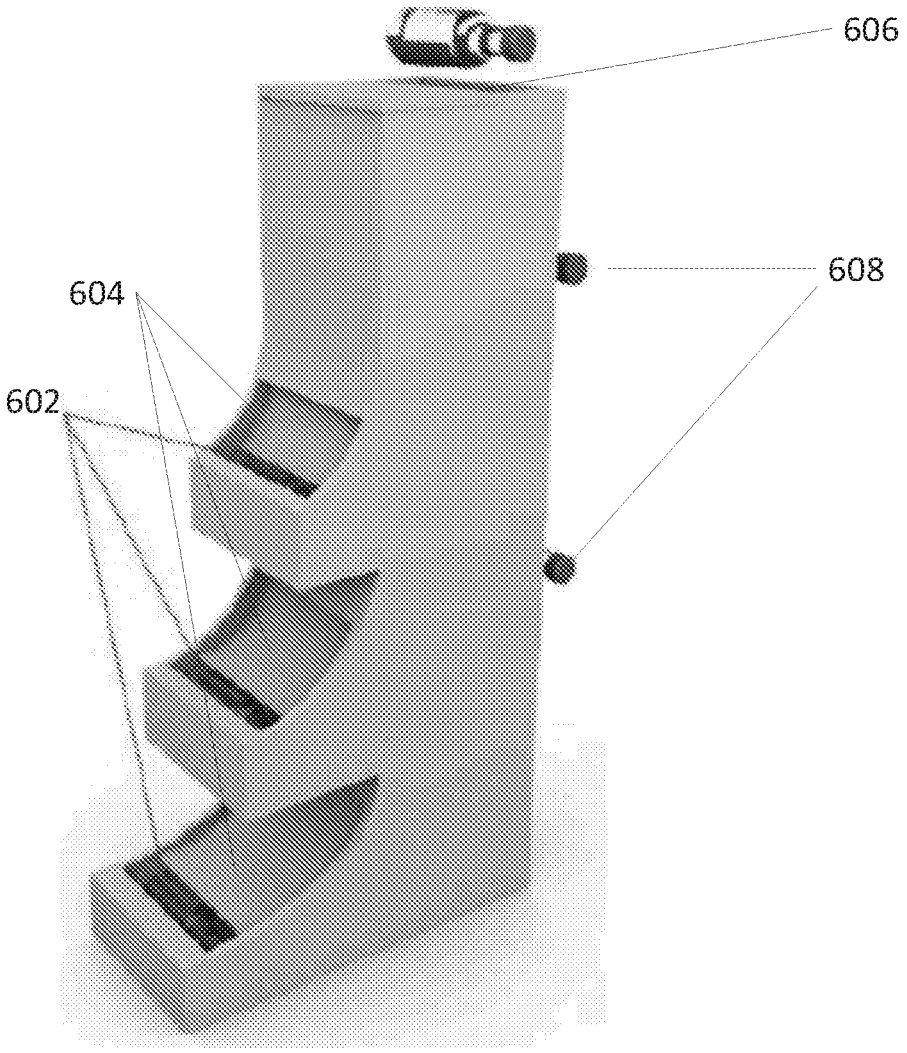
FIG. 6 illustrates a front view of a container display, according to one embodiment.

FIG. 6 illustrates a front perspective view of a container display 600 having layered front openings for dispensing beverage containers, according to one embodiment. Container display 600 includes three front openings 602 through which a consumer may access a small format beverage container, according to some embodiments. According to various embodiments, the small format beverage container may be in the form of a bottle, can, carton, jar, capsule, bag, box, vial, or other liquid vessel. The small format beverage container may have a capacity of 50 mL and have a cylindrical shape.

The access to the small format beverage containers is limited by removable curved covers 604 that are inserted inside front openings 602. Front openings 602 with covers 604 allow consumer access to a single beverage container per opening, according to one embodiment. Such a configuration minimizes the risk of theft of the small format beverage containers. According to another embodiment, multiple units can be displayed and removed from each opening.

Container display 600 has 3 levels of front openings 602. Each level may dispense the same beverage container, or different beverage containers (e.g., different flavors of vodka). In alternate embodiments, any number of levels may be used in container display 600.

Similar to previous embodiments of container displays, container display 600 may sit on top of a cashier's counter at a liquor store, or on top of a display shelf, according to one embodiment. According to another embodiment, container display 600 also includes a stand that allows the display and stand to sit on the floor.

According to some embodiments, container display 600 may have a top opening 606, as well as two rear openings 608. Container display 600 uses top opening 606 and rear openings 608 to load the display with beverage containers. Top opening 606 and rear openings 608 are large enough to allow a single beverage container to be inserted into container display 600 horizontally. According to another embodiment, multiple units can be loaded at one time in top opening 606 and rear openings 608. The number of openings may vary between top opening 606 and rear openings 608. For example, container display 600 may include numerous top openings and only one rear opening, according to some embodiments. In other embodiments, container display 600 may include numerous top openings and numerous rear openings. Alternatively, in FIG. 6, container display 600 shows one top opening 606 and numerous rear openings 608, according to some embodiments.

Figure 7:
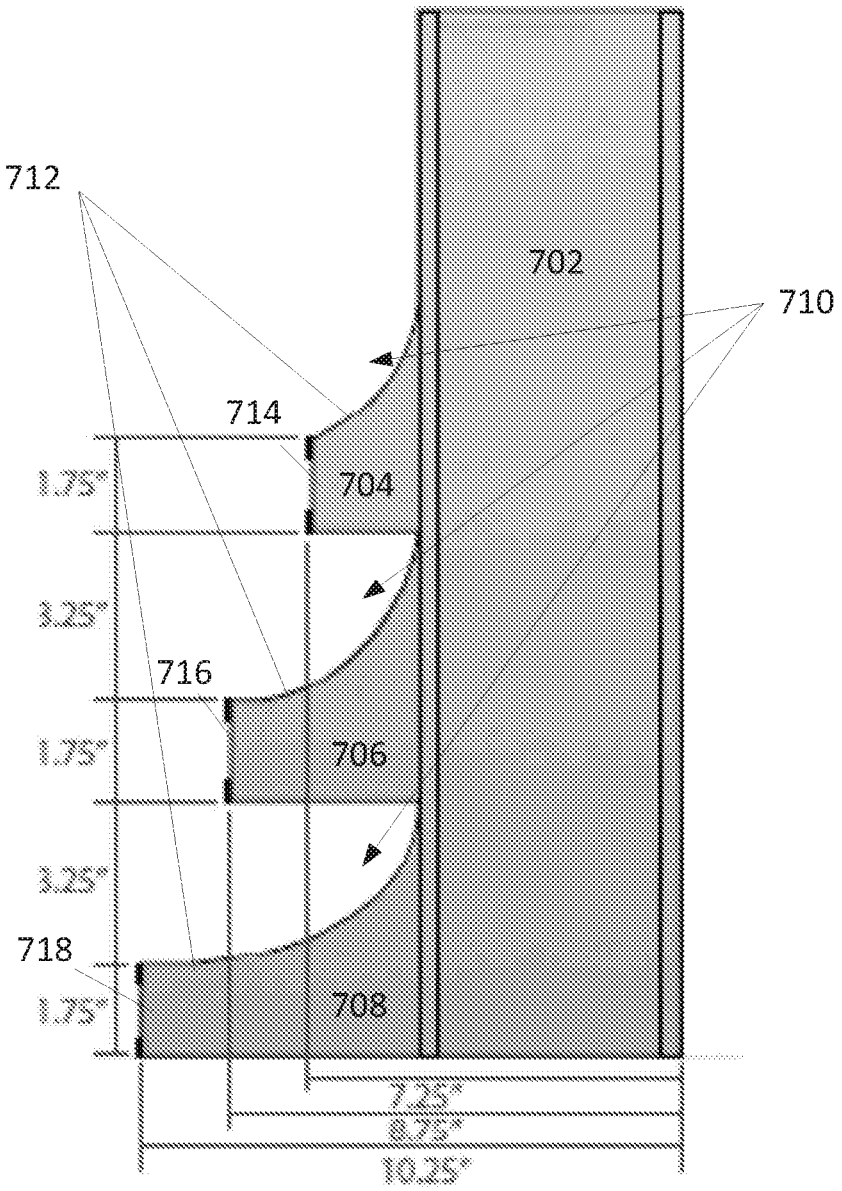
FIG. 7 illustrates a side view of a container display, according to one embodiment.

FIG. 7 illustrates a side view of container display 700, according to some embodiments. Container display 700 displays a rectangular body 702 and three ramps 704, 706, and 708 that extend from the rectangular body 702. The length of ramp 704 is shorter than ramp 706 to allow access to the front opening of ramp 706. Similarly, ramp 706 is shorter than ramp 708 to allow access to the front opening of ramp 708.

Ramps 704, 706, and 708 include three straight sides and one curved side as shown. Rectangular body 702 and ramps 704, 706, and 708 provide storage for a number of small format beverage containers, according to some embodiments.

Each ramp 704, 706, and 708, includes a spaces 710 therebetween, the spaces large enough to allow consumers to access front openings of each ramp and, thus, the beverage containers stored therein. Each ramp 704. 706, and 708 further includes front openings 712, allowing consumers to access and remove beverage containers stored within each ramp.

Furthermore, each ramp 704, 706, and 708 includes a front barrier 714, 716, and 718, respectively. Front barriers 714, 716, and 718 prevent beverage containers from falling out of container display 700. Spaces 710 between the front barriers 714, 716, and 718 are large enough to allow consumers to access openings 712 from which single beverage containers may be removed from container display 700. According to another embodiment, multiple units can be displayed and removed from each opening 712.

According to some embodiments, ramp 704 reaches 7.25 inches from the back wall of rectangular body 702, ramp 706 reaches 8.75 inches from the back wall of rectangular body 702, and ramp 708 reaches 10.25 inches from the back wall of rectangular body 702.

According to some embodiments, spaces 710 may be 3.25 inches in height between each ramp. Additionally, front barriers 714, 716, and 718 may be 1.75 inches tall, according to some embodiments.

Figure 8:
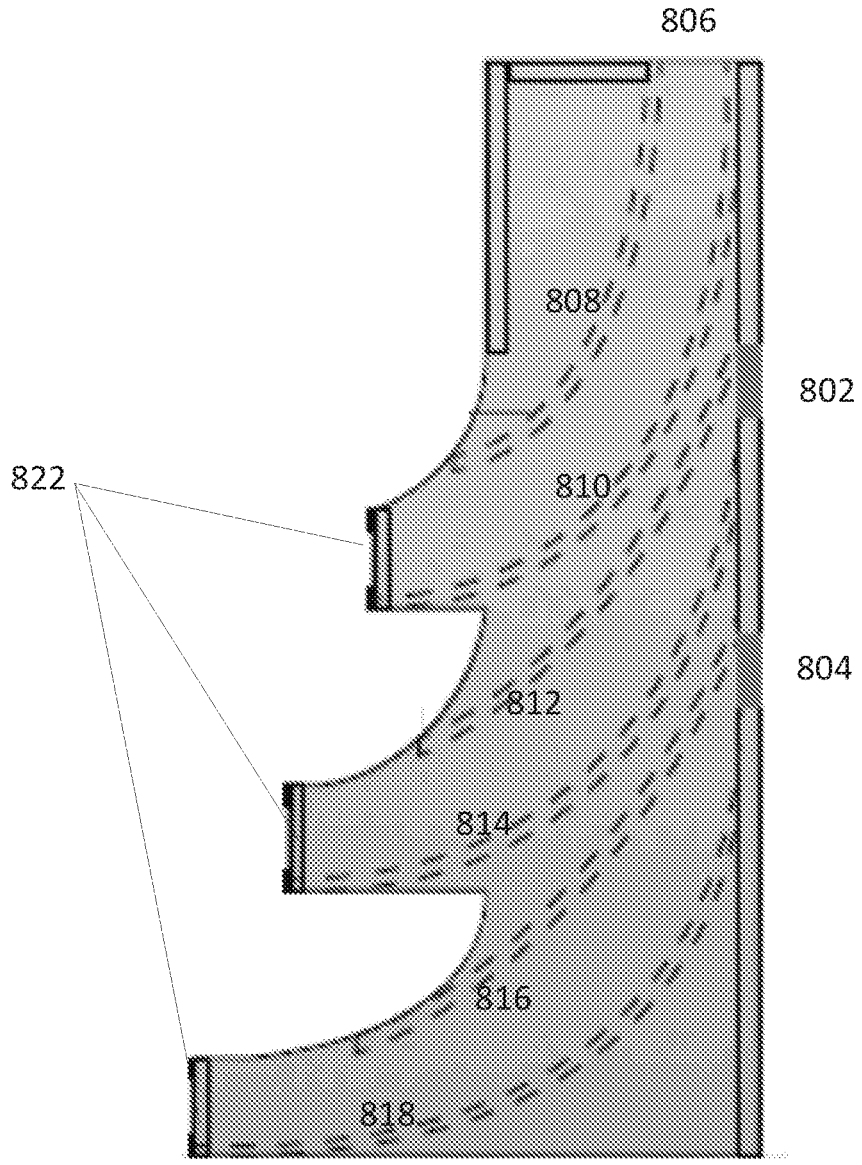
FIG. 8 illustrates a section view of a container display, according to one embodiment.

FIG. 8 illustrates a section view of a container display 800, according to some embodiments. Container display 800 shows two rear openings 802 and 804, along with top opening 806 through which beverage containers may be inserted in container display 800. Container display 800 has top slides 808, 812, and 816 extending from one edge of a rear or top opening to a front opening. Bottom slides 810, 814, and 818 extend from another edge of a rear or top opening to the bottom of a front opening. A pair of top and bottom slides may be used to form an internal channel of container display 800, similar to other internal channels of other embodiments.

According to some embodiments, slides 808-818 are curved to allow beverage containers to roll from the back to the front of container display 800. Slides 808-818 prevent the beverage containers from getting jammed inside container display 800 and ensure the beverage containers remain in a horizontal orientation. According to some embodiments, the distance between a top and bottom slide may be approximately 35 mm, which minimizes beverage containers from jamming while gravity moves them down the slide from the openings to the front barriers. The configuration of the front openings and front barriers to form overhangs, prevents the beverage containers from coming out of container display 800 when being loaded with beverage containers.

According to some embodiments, the ramp formed by top slide 816 and bottom slide 818 may drop a distance of 210 mm and travel 258 mm horizontally. The ramp formed by top slide 812 and bottom slide 814 may drop a distance of 210 mm and travel 224 mm horizontally. The ramp formed by top slide 808 and bottom slide 810 may drop a distance of 210 mm and travel 190.5 mm horizontally.

According to some embodiments, bottom slides 810, 814, and 818 include rubber mats near the front barriers 822 to retard the movement of the beverage containers. The front barriers 822 may also have foam cushion pads to retard the impact of the beverage containers when rolling down the slides 810, 814, and 818 and reaching the front barriers 822.

According to some embodiments, the surfaces of the container display include graphic channels to insert advertising graphics. The graphic channels may be on the surface of each front barrier 822, the sides, and front of the container display. The graphic channels can accommodate paper, plastic, or cardboard print advertising.

The container displays described above may be manufactured from black acrylic plastic, or any other similar material known to a person of skill in the art.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept.

Various modifications and departures from the disclosed example embodiments will occur to those having ordinary skill in the art. The subject matter that is intended to be within the scope of the present disclosure is set forth in the following claims.

The foregoing description, for purposes of explanation, used specific nomenclature to provide a thorough understanding of the invention. However, it will be apparent to one skilled in the art that specific details are not required in order to practice the invention. Thus, the foregoing descriptions of specific embodiments of the invention are presented for purposes of illustration and description. They are not intended to be exhaustive or to limit the invention to the precise forms disclosed; obviously, many modifications and variations are possible in view of the above teachings. The embodiments were chosen and described in order to best explain the principles of the invention and its practical applications, they thereby enable others skilled in the art to best utilize the invention and various embodiments with various modifications as are suited to the particular use contemplated. It is intended that later filed claims and their equivalents define the scope of the invention.

We claim:

1. An apparatus, comprising:

at least one storage chamber comprising:

at least one internal channel having a curved ramp for storing beverage containers;

a front door that provides access to the beverage containers;

a clicker device that produces a clicking noise when the front door is opened due to contact between the clicker device and a clicker actuating member; and at least one removable panel disposed on at least one side of the at least one storage chamber, wherein the at least one removable panel comprises panel magnets for attaching the at least one removable panel to the at least one side.

2. The apparatus of claim 1, further comprising a stand that supports the at least one storage chamber.

3. The apparatus of claim 1, wherein the clicker device is attached to a clicker support panel inside the at least one storage chamber.

4. The apparatus of claim 1, wherein the clicker device comprises a metal sheet to produce the clicking noise.

5. The apparatus of claim 1, wherein the front door further comprises a front bottom member and a front notched member connected to the front bottom member.

6. The apparatus of claim 1, wherein the front door comprises:

at least one pin for pivotably attaching the front door to the at least one storage chamber;

at least one spring for maintaining the front door in a closed position; and a curved member for receiving the beverage containers from the at least one internal channel.

7. The apparatus of claim 1, wherein the curved ramp is S-shaped or J-shaped.

8. The apparatus of claim 1, wherein the curved ramp maintains the beverage containers in a horizontal orientation.

9. The apparatus of claim 1, wherein the at least one storage chamber comprises two side-by-side storage chambers.

10. The apparatus of claim 1, wherein the at least one internal channel comprises two or more internal channels, the two or more internal channels each comprising a corresponding curved ramp for storing a respective set of beverage containers.

11. The apparatus of claim 10, wherein each of the two or more internal channels is associated with a respective loading opening.

12. The apparatus of claim 1, wherein the front door comprises the clicker actuating member.

13. The apparatus of claim 12, wherein the front door comprises a rear bottom member, and wherein the clicker actuating member is disposed on the rear bottom member.

14. The apparatus of claim 1, further comprising a plurality of panels defining the at least one storage chamber, the plurality of panels comprising:

one or more front panels;

a left panel;

a right panel;

one or more back panels; and one or more bottom panels.

15. The apparatus of claim 14, wherein the plurality of panels comprises one or more graphic channels to receive one or more insertable advertising sheets.

16. The apparatus of claim 14, wherein the plurality of panels comprises at least one keyhole that facilitates attaching the at least one storage chamber to a display stand, a countertop, a floor, or a support structure.

17. The apparatus of claim 14, wherein the plurality of panels defines a loading opening that provides access for loading the beverage containers in the at least one internal channel.

18. The apparatus of claim 1, wherein the at least one side comprises anchor magnets for magnetically coupling to the panel magnets.

* * * * *